US008800739B2

(12) United States Patent
McDonnell et al.

(10) Patent No.: US 8,800,739 B2
(45) Date of Patent: Aug. 12, 2014

(54) SPOOLING APPARATUS FOR SURVEY WIRE

(75) Inventors: Shamus McDonnell, Edmonton (CA); Gordon Lischuk, Edmonton (CA)

(73) Assignee: Spectrum External Line Inspection Technology Inc., Edmonton, Alberta (CA)

( * ) Notice: Subject to any disclaimer, the term of this patent is extended or adjusted under 35 U.S.C. 154(b) by 113 days.

(21) Appl. No.: 13/455,695

(22) Filed: Apr. 25, 2012

(65) Prior Publication Data

US 2012/0273603 A1 Nov. 1, 2012

(30) Foreign Application Priority Data

Apr. 26, 2011 (CA) ..... 2738394

(51) Int. Cl.
*H02G 11/02* (2006.01)
*B65H 54/00* (2006.01)
*B65H 75/14* (2006.01)

(52) U.S. Cl.
USPC ..... 191/12.2 R; 200/61.15

(58) Field of Classification Search
USPC ..... 191/12.4, 12.2 R; 324/323, 357, 329, 324/71.1, 72; 702/59; 346/33 P; 200/61.15
See application file for complete search history.

(56) References Cited

U.S. PATENT DOCUMENTS

| | | | | |
|---|---|---|---|---|
| 2,478,775 | A * | 8/1949 | Mundt | 200/61.15 |
| 4,151,458 | A | 4/1979 | Seager | |
| 4,438,391 | A | 3/1984 | Rog et al. | |
| 6,942,079 | B2 * | 9/2005 | Chang | 191/12.4 |
| 8,118,147 | B2 * | 2/2012 | Ori et al. | 191/12.2 R |

* cited by examiner

*Primary Examiner* — Mark Le
(74) *Attorney, Agent, or Firm* — Davis & Bujold, PLLC; Michael J. Bujold

(57) ABSTRACT

A spooling apparatus includes a spool for holding wire, the spool having a wire-retaining section and end plates, the end plates having one or more apertures. A conductive plate is positioned on an end plate of the spool opposite the wire-retaining section, and at least one conductive extension that extends through a corresponding aperture of the end plate such that the conductive extension is adjacent to the wire retaining section. Wire is spooled onto the wire-retaining section, at least a portion of the wire being uninsulated and in electrical contact with the conductive extensions of the conductive plate.

7 Claims, 6 Drawing Sheets

SPOOLING APPARATUS FOR SURVEY WIRE

FIELD

This relates to a spooling apparatus for survey wire, such as an apparatus for making electrical connection with a buried conductor during indirect inspection,

BACKGROUND

To prevent corrosion, buried pipelines and storage tanks (hereafter referred to as "pipelines") are protected in two ways: by coating them with an insulating barrier that separates them from the corrosive effects of the soil; and, by making their surfaces cathodic with respect to their environment, a process called cathodic protection (CP). However, to ensure that the CP system is functioning properly and providing adequate protection to the pipelines based on minimum recommended standards, pipelines are regularly subjected to routine inspection called close interval potential surveys (CIPS). This is a rather time-consuming and labor intensive process because it involves traversing the entire length of the pipeline and taking pipe-to-soil potential (PSP) measurements at regular intervals of approximately three feet. This is made possible by a 2 to 3 mile of 34 gauge coated copper wire wound around a spool with one end connected to the pipeline, and the other to the positive end of a voltmeter.

Unfortunately, the copper wire is very fragile and often breaks along its length due to entanglements with obstacles, including the surveyor himself, along the right-of-way. The aspect of the wire breaks that is particularly of concern to this invention is at the spool-to-voltmeter end of the connection—a point where it is oftentimes too difficult or impractical to reconnect in the field. In this instance, most surveyors often discard the remaining length of wire spool, or drive a nail down the remaining spool to re-establish electrical connection, a method that is unreliable and still involves waste of the copper wire. It would be highly advantageous to have a means of maintaining electrical connection at this difficult location of the spool, thereby avoiding economic loss and excessive time waste during CIPS.

Examples of spooling apparatuses are shown in U.S. Pat. No. 4,151,458 (Seager) entitled "Closely spaced pipe-to-soil electrical survey method and apparatus" and U.S. Pat. No. 4,438,391 (Rog et al.) entitled "Electrical survey apparatus and method with spinner-type conductor supply".

SUMMARY

According to an aspect, there is provided an apparatus for making electrical connection with a buried conductor during indirect inspection. The apparatus helps maintain and re-establish wire-to-pipeline electrical connection in the event of a wire break during CIPS. The apparatus may be used to ensure continual electrical connection with pipelines and storage tanks to measure the electrical potential difference between the pipe and the surrounding soil during so-called close interval surveys.

Accordingly, there is provided a spooling apparatus, comprising a spool for holding wire, the spool having a wire-retaining section and end plates. A conductive plate is positioned on an end plate of the spool opposite the wire-retaining section, and at least one conductive extension that extends through a corresponding aperture of the end plate such that the conductive extension is adjacent to the wire retaining section. A wire is spooled onto the wire-retaining section. At least a portion of the wire is uninsulated and in electrical contact with the conductive extensions of the conductive plate.

According to another aspect, the uninsulated portion may be in electrical contact with the conductive extensions by wrapping the uninsulated portion around the spool.

According to another aspect, a section of the uninsulated portion may extend through an aperture of the end plate such that it is in electrical contact with the conductive plate. The section of the uninsulated portion may be positioned between the conductive plate and the end plate.

According to another aspect, the conductive plate may comprise a connection point for connecting to an external voltmeter.

According to another aspect, the spool may define an axially extending, central aperture, and the conductive plate may have an aperture aligned with the central axis of the spool, and may further comprising a conductive attachment electrically connected to the conductive plate and extending through the central aperture and the central axis of the spool, where the conductive attachment has a connection point for connecting to an external voltmeter.

According to another aspect, the apparatus may further comprise a spool holder, the spool holder comprising a wire controlling portion that is positioned adjacent to at least one end plate of the spool.

According to another aspect, the conductive attachment may be used to secure the spool to the spool holder.

According to another aspect, the spool holder may comprise a flexible material shaped to have an inner cavity with an inner diameter that is substantially the same size as the diameter of the end plates of the spool.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
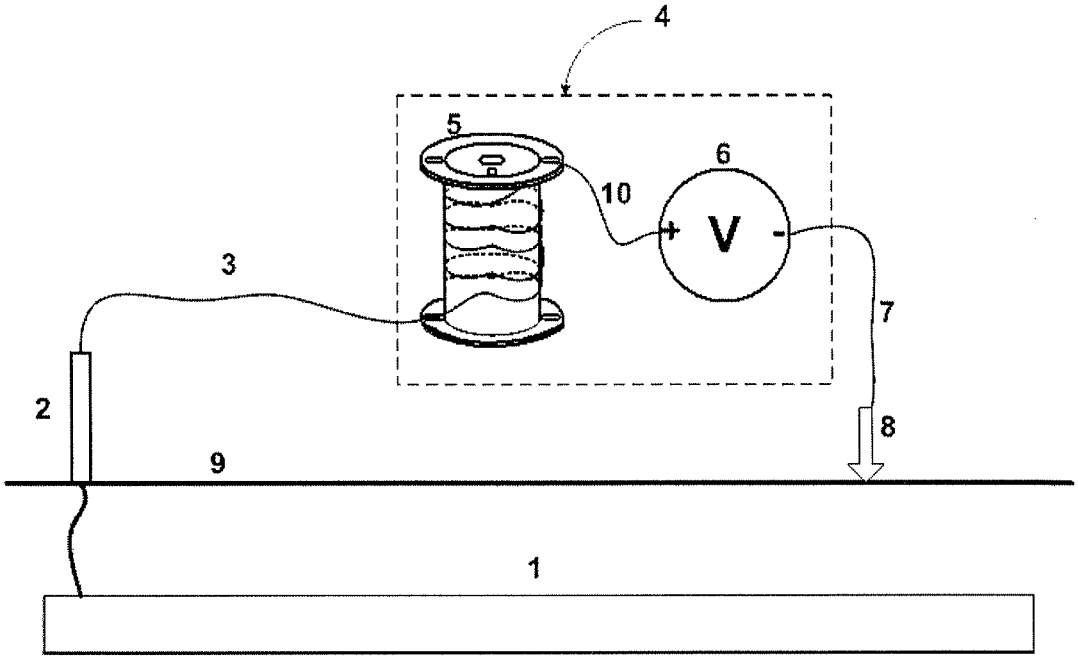
FIG. 1 is a schematic representation of a typical close interval potential survey scenario where the surveyor moves along the pipeline gathering pipe-to-soil potential measurements.

A spooling apparatus, generally identified by reference numeral 10, will now be described with reference to FIG. 1 through 7.

FIG. 1 shows schematically a typical close interval potential survey scenario. The wire 3 at the leading, or open end of the wire spool 5 is connected to the pipeline 1 via the above ground test post 2. The inside end of the wire 10, sometimes referred to as the pig tail, is connected to positive lead of the voltmeter 6. Both spool 5 and voltmeter 6 are mobile with the surveyor, depicted by the box 4. The negative lead of the voltmeter 6 is connected via wire connection 7 to an electrode 8 for measuring the pipe-to-soil potential at regular intervals of approximately 3 feet on the ground 9.

Figure 2:
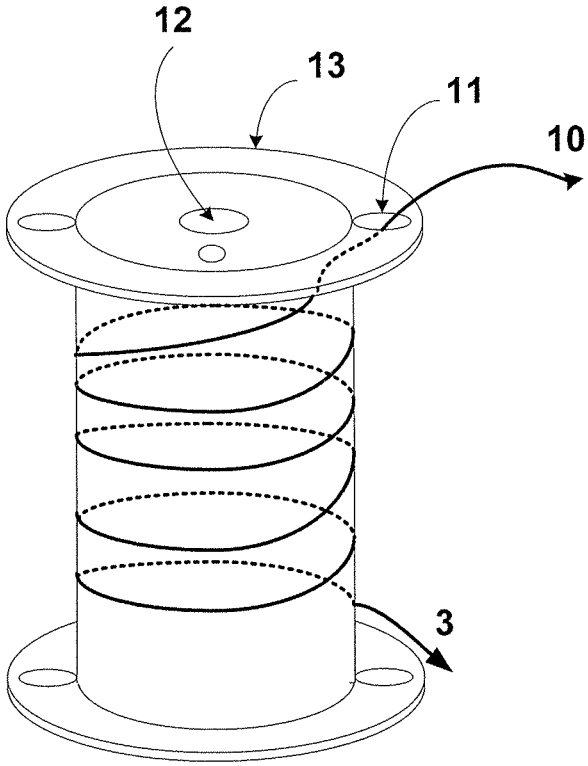
FIG. 2 is a schematic representation of a conventional wire spool system for CIPS.

FIG. 2 is a more detailed description of a typical model gauge #34 copper wire spool that is commonly used in surveying. The wire is shown loosely wound for illustration purposes only. The winding process starts out with pig tail 10 hanging out of the slot 11 for connection to the voltmeter 6 (shown in FIG. 1). This may be done directly or via other connecting devices, as would be shown later. The finished product generally contains copper wire 2.5 cm thick tightly wound together, leaving the pig tail 10 buried deeply in the windings and the open end 3 for connection to above ground feature 2 of the pipeline. The buried pig tail of the copper windings is problematic because, when a wire break occurs here, it often leaves behind a trailing end of the wire that is difficult to reconnect to the voltmeter, especially during unfavorable survey conditions such as harsh climate. Thus, the surveyors often abandon the remaining wire spool in favor of a new spool, regardless of how much wire is remaining.

Figure 3:
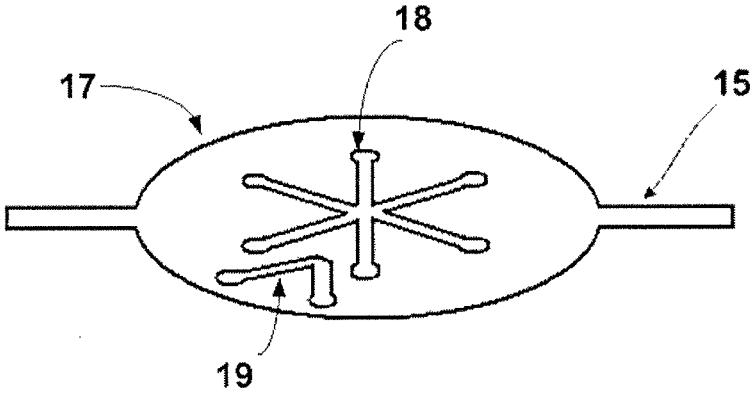
FIG. 3 is a copper shim stock "washer" that helps maintain contact with the pig tail of the copper winding around the spool.
Figure 4:
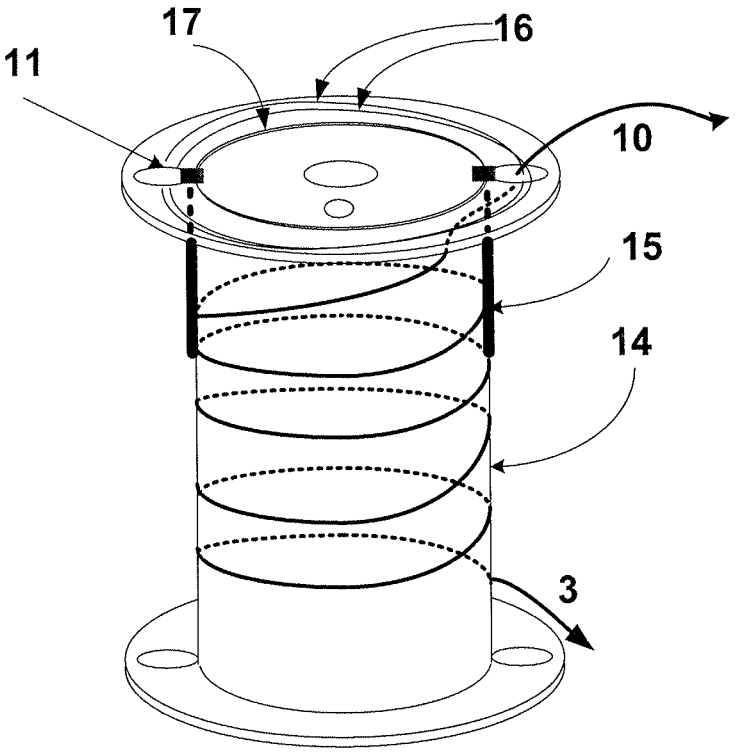
FIG. 4 is a wire spool system incorporating the spooling apparatus for ensuring ease of reconnection to the voltmeter during survey.
Figure 5:
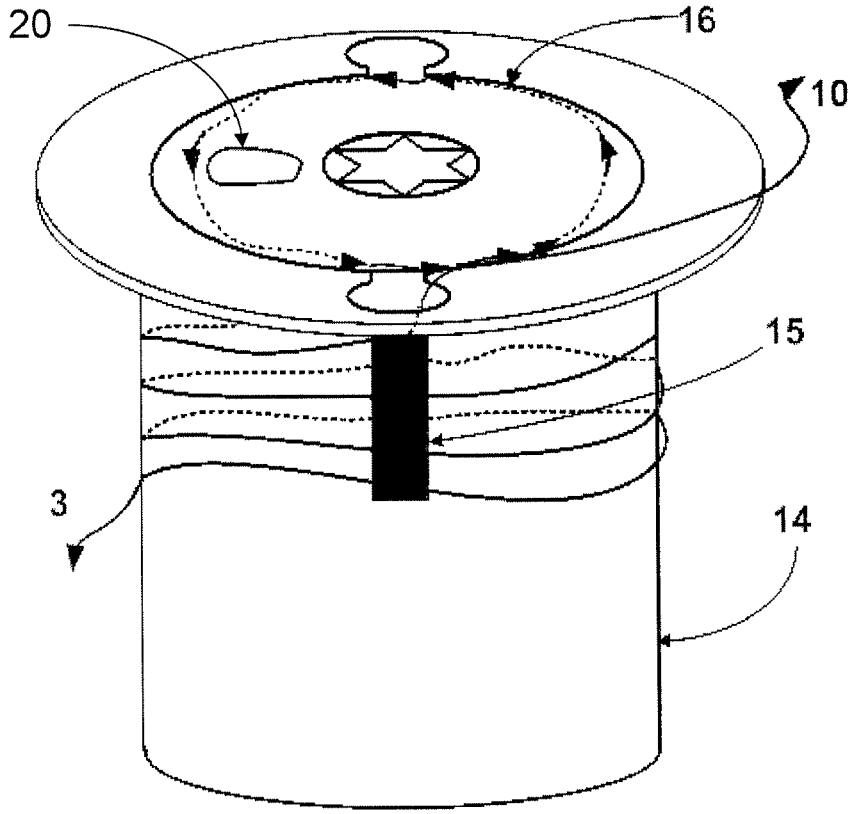
FIG. 5 is a detailed view of the spool with the pig tail wrapped between the washer and the spool's end plate.

FIG. 3 is a copper shim stock "washer" 17, which generally has a 4 cm diameter for typical wire spools, for establishing permanent electrical connection with the pig tail of the copper wire. Washer 17 preferably has a central portion with a cut-out multi-finger middle section 18 that is bent inwards to be flush with the hollow channel 12 and upper plate 13, of the spool 5. The washer 17 also has two winged sections 15, each of which are 2.5 cm long, which are bent to lie flush with the body 14 of the spool, prior to the copper wire being wound onto the spool 5, as shown in FIG. 4. Additionally, there is preferably a cut-out V-section 19 that can be bent inwards into the hollow channel 12 of plate 13 and spool body 5. These various parts of washer 17 help secure washer 17 to spool 5 and make a good connection with the copper wire. Note that the thickness of the wings 15 relative to the spool body 14 is exaggerated for illustration purposes only. Prior to winding the copper onto the spool body 14, the copper wire is stripped of their external coatings to provide one or more, and preferably many, windings over wings 15 of the washer 17, and wound tightly around 15 several revolutions before passing the pig tail through 11. Preferably, the stripped wire passes over, rather than under, the wings 15 as it is being wound, as with the rest of the unstrapped wire. After passing through 11, the pig tail 10 is preferably wound several revolutions between the central portion 18 of washer 17 and the upper plate 13 of the wire spool apparatus, making sure that contact is maintained with the washer 17, as shown in FIG. 5. The pig tail can then be connected to the voltmeter 6. Thus, in the event of a wire break—which would have normally been difficult to reconnect, as described earlier—any portion of the pig tail can be used to easily re-establish electrical contact. It should be noted here that, to increase contact with the copper wire at the pig tail end of the winding, several slots 11 can be used.

Figure 6:
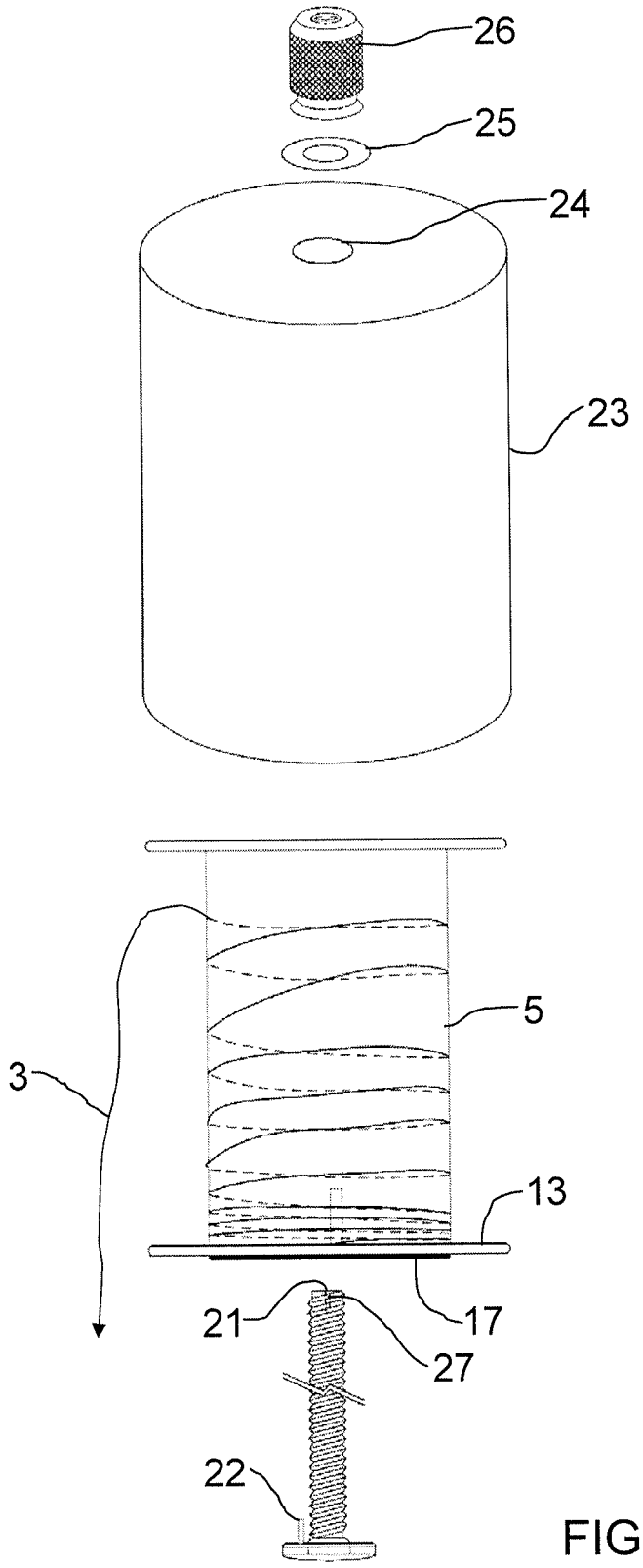
FIG. 6 is an exploded view of the wire spool housing assembly.

Alternatively, referring to FIG. 6, instead of using the pig tail 3 to connect to the voltmeter 6, the washer 17 may be electrically connected to the voltmeter directly, either by providing a connection point on the washer, or by passing an electrically conductive bolt (or other elongate connector) through the spool, one end of which is in electrical contact with the washer 17, and which is also in electrical contact with a connection point for the voltmeter 6, as described shortly.

Figure 7:
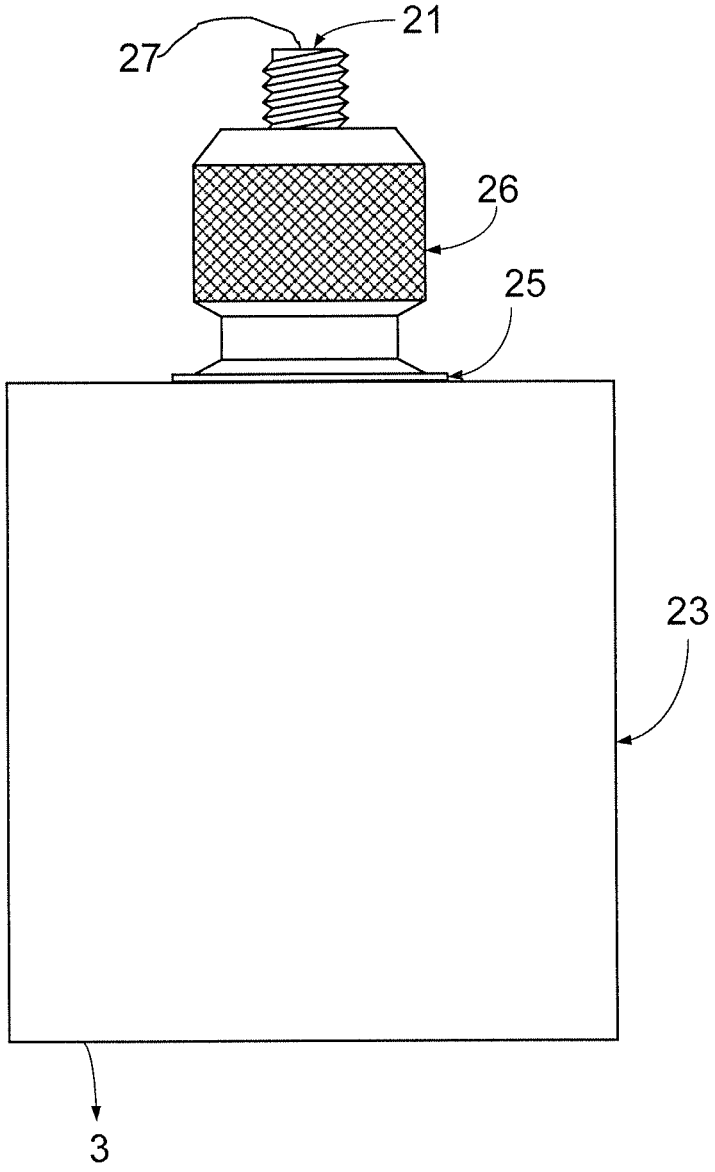
FIG. 7 is a side elevation view of the assembled wire spool assembly.

Referring to FIG. 6, the bolt 21 is inserted into the spool 5, allowing the welded protrusion 22 on the bolt to align with, and be inserted into the hollow channel 20 on the spool upper plate 13. At the same time, the bolt head makes electrical contact with the washer 17, which is already in contact with the pigtail 3. As a result, the copper wire, pigtail 3, washer 17, and bolt 21 are at the same electrical potential. The bolt-spool assembly is then placed inside the housing 23 with the bolt screw end through opening 24 in housing 24. Finally the end washer 25 and nut 26 are threaded onto the protruding end of bolt 21, to secure the spool 5 inside the housing 23, and allowing the wire to spool out from one end 3 of the spool. FIG. 7 is the final assembly, where the spool carrier provides enough resistance to the wire being deployed to prevent it from falling off the spool in an uncontrolled manner. For example, housing 24 may be made from, or include a liner that is made from, a flexible material shaped to have an inner cavity with an inner diameter that is substantially the same size as the diameter of the end plates of spool 5. In one example, it has been found that an appropriately sized "faux-fur" lining provides beneficial qualities, and is relatively easy and economical to manufacture. The bolt referred to previously can be used to secure the spool in the carrier. Additionally, since the bolt 21 is at the same electrical potential with the pigtail 3 and the washer 17, direct connection can be made to the voltmeter via a sturdy alligator clip 27 affixed onto the hollow of bolt 21. As it is external to the spool 5, the voltmeter connection can be made very robust, such that it operates independently from the problems inherent with the relatively fragile copper wire. This design also makes is easy for surveyors to quickly change copper wire spools in the field, if necessary.

Those involved in regular pipeline survey will appreciate that the benefit of the additional cost of the copper shim stock far outweighs the frustration and time wasted due to wire breakage, in addition to the added cost of discarding what may be several miles of copper wires. In addition, the simplicity of the preferred spool carrier further reduces the cost and simplifies the installation process.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A spooling apparatus comprising:

a spool for holding wire, the spool having a wire-retaining section and end plates, the wire-retaining section having an outer surface, and the spool defining an axially extending, central aperture;

a conductive plate positioned on an end plate of the spool adjacent the wire-retaining section, the conductive plate having an aperture aligned with the central axis of the spool, and at least one conductive extension that extends through a corresponding aperture of the end plate such that the at least one conductive extension is outside the spool and adjacent to the outer surface of the wire retaining section, the conductive plate further comprising a conductive attachment electrically connected to the conductive plate and extending through the central aperture and the central axis of the spool, and the conductive attachment having a connection point for connecting to an external voltmeter; and a wire spooled onto the wire-retaining section, at least a portion of the wire being uninsulated and in electrical contact with the at least one conductive extension of the conductive plate.

2. The spooling apparatus of claim 1, wherein a plurality of revolutions of the uninsulated portion contacts the at least one conductive extension.

3. The spooling apparatus of claim 1, wherein a section of the uninsulated portion extends through an aperture of the end plate and is in electrical contact with the conductive plate.

4. The spooling apparatus of claim 3, wherein the section of the uninsulated portion is positioned between the conductive plate and the end plate.

5. The spooling apparatus of claim 1, further comprising a spool holder, the spool holder comprising a wire controlling portion that is positioned adjacent to at least one end plate of the spool.

6. The spooling apparatus of claim 5, wherein the conductive attachment is used to secure the spool to the spool holder.

7. The spooling apparatus of claim 5, wherein the spool holder comprises a flexible material shaped to have an inner cavity with an inner diameter that is substantially the same size as the diameter of the end plates of the spool.

* * * * *